US006366676B1

(12) United States Patent
Neilson

(10) Patent No.: US 6,366,676 B1
(45) Date of Patent: Apr. 2, 2002

(54) PROGRAMMING PILL AND METHODS OF MANUFACTURING AND USING THE SAME

(75) Inventor: Mark A. Neilson, Zimmerman, MN (US)

(73) Assignee: In'Tech Industries, Ramsey, MN (US)

( * ) Notice: Subject to any disclaimer, the term of this patent is extended or adjusted under 35 U.S.C. 154(b) by 0 days.

(21) Appl. No.: 09/082,642

(22) Filed: May 21, 1998

(51) Int. Cl.[7] ..... H04R 25/00

(52) U.S. Cl. ..... 381/314; 381/323; 381/312

(58) Field of Search ..... 381/314, 323, 381/324, FOR 137, FOR 127, FOR 129, 312, 315, 328

(56) References Cited

U.S. PATENT DOCUMENTS

| | | | | | |
|---|---|---|---|---|---|
| 4,075,561 | A | * | 2/1978 | Stevens | 324/149 |
| 4,548,082 | A | * | 10/1985 | Engebretson | 381/320 |
| 4,961,230 | A | * | 10/1990 | Rising | 381/323 |
| 5,188,540 | A | * | 2/1993 | Haertl et al. | 381/68 |
| 5,404,407 | A | * | 4/1995 | Weiss | 381/68 |
| 5,500,901 | A | * | 3/1996 | Geraci | 381/323 |
| 5,502,769 | A | * | 3/1996 | Gilbertson | 381/309 |
| 5,586,188 | A | * | 12/1996 | Renggli | 381/312 |

FOREIGN PATENT DOCUMENTS

| | | | |
|---|---|---|---|
| DE | 3416576 C1 | 5/1984 | H04R/25/00 |
| EP | 487413 A1 | 11/1990 | H04R/25/000 |
| EP | 0702502 | 9/1994 | H04R/25/02 |
| JP | 61230020 A | 10/1986 | G01B/21/00 |
| WO | 96/27932 | 3/1995 | H02B/1/24 |

* cited by examiner

*Primary Examiner*—Sinh Tran
*Assistant Examiner*—Phylesha Dabney
(74) *Attorney, Agent, or Firm*—Nelson R. Capes; Rider, Bennett, Egan & Arundel

(57) ABSTRACT

An apparatus for programming a hearing aid comprises an indexed pill that substantially replicates the dimensions of a hearing aid battery and battery compartment door. The apparatus, comprises two power contacts on opposite exterior sides of the indexed pill; and two programming contacts on opposite exterior sides of the indexed pill.

13 Claims, 6 Drawing Sheets

231
207
209
232
201
208

232
207
201
231
210
212
208

202
210
232
231
211
208
207

202
209
231
232
207
108

PROGRAMMING PILL AND METHODS OF MANUFACTURING AND USING THE SAME

FIELD OF THE INVENTION

The present invention generally relates to programmable systems, and more specifically to programmable hearing aids.

BACKGROUND OF THE INVENTION

Persons with hearing deficiencies wear hearing aids to improve their hearing ability. However, because each person's hearing characteristics are different, each hearing aid is preferably custom programmed to optimize hearing aid performance for each user. For example, each user's frequency response (i.e. gain versus frequency) can be different. Thus, for example, hearing aid gain at high frequencies can be enhanced for users who have diminished hearing in that spectrum.

Conventionally, programming signals are fed from a programming system through wires to a plug inserted into a receptacle on the exterior of the hearing aid. However, the receptacle is relatively bulky, and thus undesirably increases the size of the hearing aid. Large hearing aid size is undesirable to users for cosmetic reasons. Users typically prefer to wear small hearing aids that are not readily visible to others.

Therefore, it is preferable to replace the exterior receptacle with a programming contact in a battery compartment of the hearing aid. As a result, hearing aid size is diminished.

A plug, having contacts for providing both programming signals and power, can be inserted into the battery compartment in lieu of a battery. The hearing aid can then be programmed because the programming contacts, of the plug and battery compartment, are connected.

FIG. 1A illustrates a prior art embodiment of a programming system 101 coupled to a hearing aid 103 by a plug 111. The hearing aid includes a microphone 107 and speaker 105 that are coupled by an amplifier 109. The microphone 107 receives audio signals that are amplified, or otherwise processed, by the amplifier 109, and then broadcast through the speaker 105. The plug 111 is coupled to programming electronics 113 and the amplifier 109. The plug 111 provides electrical power from the programming system 101 to the programming electronics 113 and the amplifier 109 to permit those components to function. The plug 111 further provides programming signals from the programming system 101 to the programming electronics 113. The programming electronics 113 controls, for example, the frequency response of the amplifier 109, and thus the hearing aid 103.

U.S. Pat. Nos. 4,961,230 to Rising (hereinafter the "'230 Patent") and 5,500,901 to Geraci et al. (hereinafter the "'901 Patent"), which are both hereby incorporated by reference, disclose plugs, or modules, that can be inserted into battery compartments of hearing aids.

Conventionally, a battery is inserted into the battery compartment. The battery 152 may be inserted into the battery door 152, which is mounted on an axle 156 of the hearing aid 103, as illustrated in prior art FIG. 1B.

The '230 Patent teaches a plug that is inserted, in lieu of a battery, into the hinged door of a battery compartment of a hearing aid. FIG. 1B illustrates a prior art battery 154 in a battery door 152. The plug includes a substantially flat strip which is inserted in a gap between a hearing aid face plate and the hinged door. The flat strip includes conductors coupled to the programming system. Because of its delicate structure, the flat strip can be easily damaged during use, and thus has a limited lifetime. Therefore, there is a need for a plug having enhanced reliability.

The '901 Patent teaches removing the battery compartment door of a hearing aid, and replacing it with a module that is inserted into the battery compartment. The module, thus, does not require the flat strip. External wiring is directly connected to the module. Hence, the module has enhanced reliability.

However, a hearing aid, with either the plug of the '230 Patent or the module of the '902 Patent inserted in the battery compartment, fails to replicate the normal acoustical conditions of the hearing aid that exist when the battery is inserted into the battery compartment. For example, the flat strip of the '230 Patent blocks a gap between the hearing aid face plate and battery door. As a result, acoustical feedback between a hearing aid microphone and speaker may be dampened, in comparison to normal hearing aid operation. Similarly, the module consumes more volume in the battery compartment in comparison to the battery and the battery door, and thus also diminishes acoustical feedback.

Acoustical feedback affects the frequency response of the hearing aid. Therefore, when the plug or module is inserted into the battery compartment, the frequency response of the hearing aid may be altered. Programming will compensate for the frequency response of the hearing aid with the plug or module inserted. However, because the acoustical performance of a hearing aid that is being programmed with a plug or module does not accurately replicate the normal acoustical performance of the hearing aid having a battery inserted into the battery compartment, programming may not enhance the performance of the hearing aid during normal use. Therefore, there is a need for a plug or module, that can be inserted into the battery compartment of a hearing aid, which will not substantially affect the hearing aid's acoustical performance.

SUMMARY OF THE INVENTION

The present invention solves the above-mentioned problems in the art and other problems which will be understood by those in the art upon reading and understanding the present specification. The present invention provides an indexed pill for a programmable hearing aid, and methods of manufacturing and using the same. The indexed pill may be inserted into the battery compartment of the hearing aid to provide programming signals and power to the hearing aid, without substantially affecting the hearing aid's acoustical performance.

In one embodiment, an apparatus for programming a hearing aid comprises an indexed pill that substantially replicates the dimensions of a hearing aid battery and battery compartment door. In another embodiment, the apparatus, comprises two power contacts on opposite exterior sides of the indexed pill; and two programming contacts on opposite exterior sides of the indexed pill.

In another embodiment, an apparatus comprises a programming system, and an indexed pill coupled to the programming system. The indexed pill substantially replicates the dimensions of an audio system battery and battery compartment door.

In yet a further embodiment, the apparatus further comprises a programmable hearing aid into which the indexed pill is inserted in lieu of a battery. The programmable hearing aid includes a microphone, a speaker, an amplifier coupling the microphone and speaker, and programming electronics. The programming electronics are coupled to the amplifier, and controls the frequency response of the amplifier in response to programming signals from the programming system. The amplifier and programming electronics are coupled to the indexed pill. The insertion of the indexed pill into the programmable hearing aid does not substantially affect the acoustical performance of the programmable audio system.

In yet another embodiment, the apparatus comprises first means for processing audio, and second means, for providing power and programming signals, that is coupled into the first means. The second means does not substantially affect the acoustical performance of the first means.

In a further embodiment, a method comprises the step of inserting an indexed pill, in lieu of a battery, into the battery compartment of a programmable audio system so as not to substantially affect the acoustical performance of the programmable hearing aid. Programming signals and power are provided to the programmable audio system from the programming system through the indexed pill.

DETAILED DESCRIPTION OF THE EMBODIMENTS

In the following detailed description of the preferred embodiments, reference is made to the accompanying drawings which form a part hereof and in which are shown by way of illustration specific embodiments in which the invention may be practiced. These embodiments are described in sufficient detail to enable persons skilled in the art to practice the invention, and it is to be understood that other embodiments may be utilized and that logical, mechanical and electrical changes may be made without departing from the scope of the present invention. The following detailed description is, therefore, not to be taken in a limiting sense.

Figure 1B:
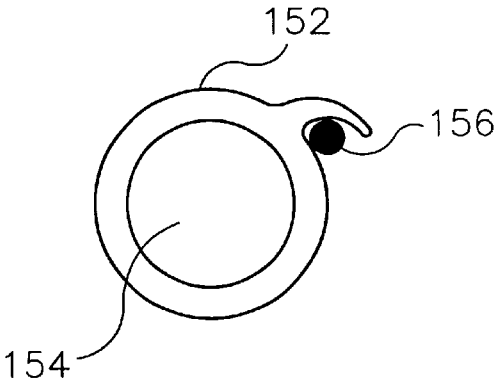
Prior Art FIG. 1B
FIG. 1B illustrates a prior art battery and battery door.
Figure 1A:
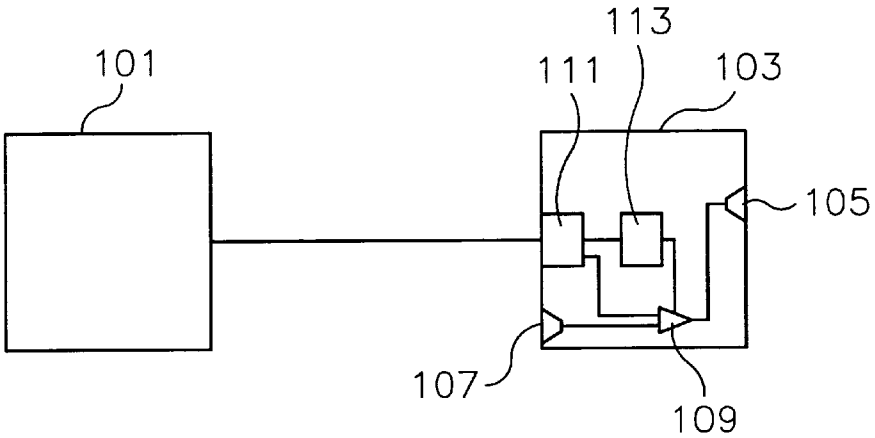
Prior Art FIG. 1A
FIG. 1A illustrates a prior art hearing aid and programming system.
Figures 2A, 2B, 2C, 2D:
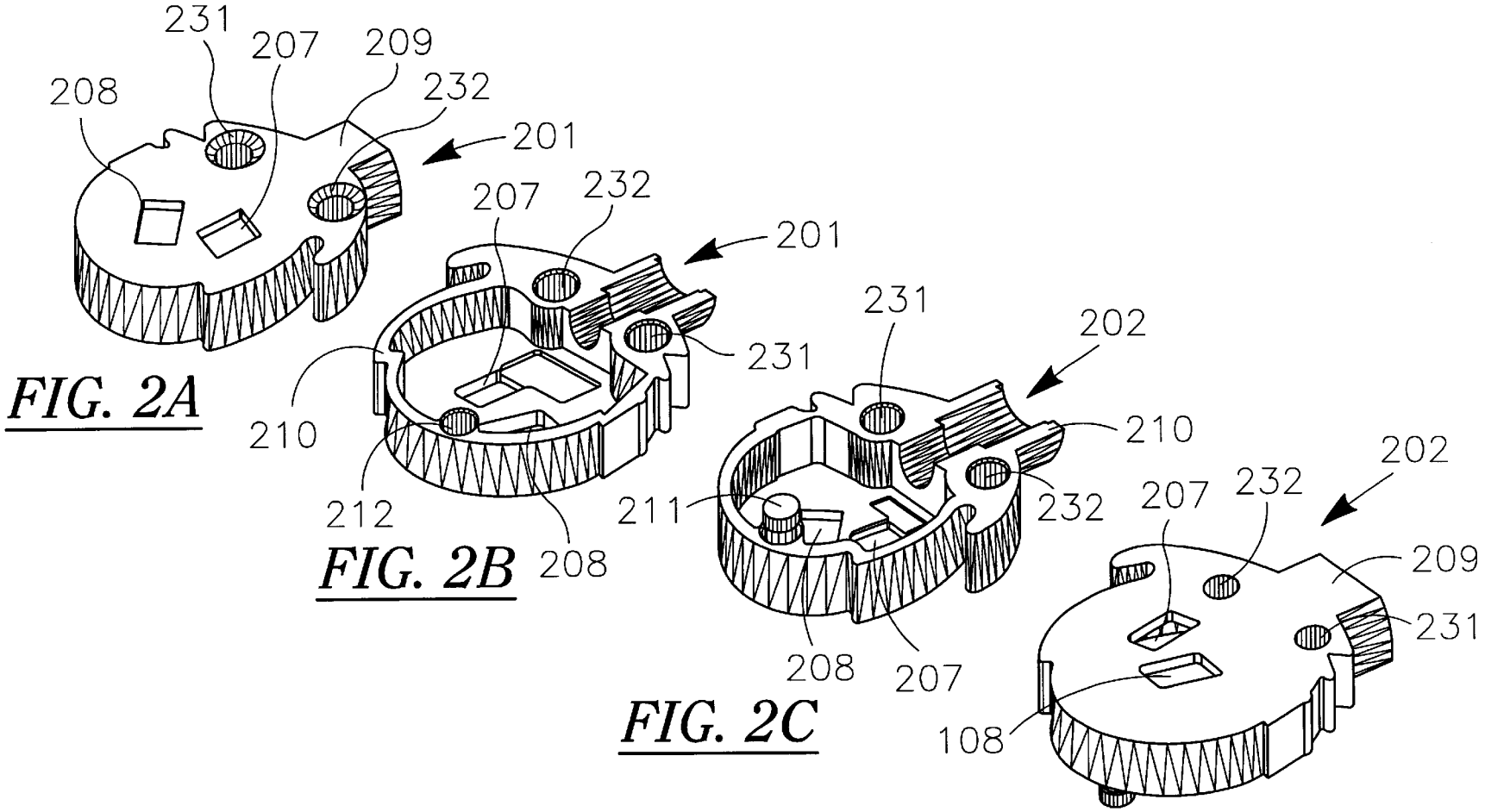
FIGS. 2A–D illustrate one embodiment of two halves of a pill.

The present invention provides a pill for a programmable hearing aid, and a method of manufacturing and using the same. The pill is a device that is inserted into an opening of another device, for example, to provide electrical signals to the another device. In one embodiment, the pill is inserted into the battery compartment of a hearing aid in lieu of a battery and a battery compartment door. In another embodiment, the pill substantially replicates the dimensions of the battery and battery compartment door illustrated in FIG. 1B. Therefore, when the pill is inserted into the battery compartment of the hearing aid and battery door, the hearing aid acoustical performance is substantially identical to the hearing aid acoustical performance when a battery is inserted.

The pill includes at least one programming contact. When the pill is inserted into the battery compartment, the pill's programming contact connects with the battery's programming contact in the battery compartment. As a result, a programming system coupled to the pill can program the hearing aid.

In one embodiment, the pill comprises two halves. Each half is substantially symmetrical. Both halves 201, 202 are illustrated in FIGS. 2A–D. Each half 201, 202 has a front side 209 and a back side 210. The front side 209 of each half faces the walls of the battery compartment of the hearing aid when the pill is inserted into the battery compartment. Programming and power contacts are fitted into corresponding openings 207, 208 in each half. As a result, the programming and power contacts protrude through the corresponding openings 207, 209.

Figure 3B:
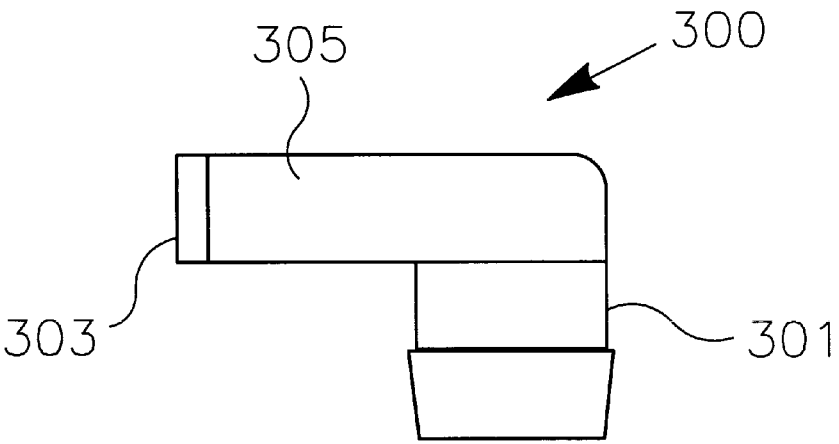
FIG. 3B illustrates a plan view of one embodiment of the programming contact.
Figure 3A:
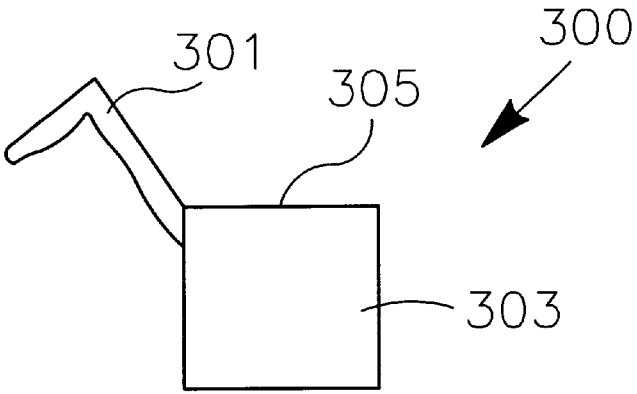
FIG. 3A illustrates a side view of one embodiment of a programming contact.

The programming contact 300, illustrated in FIGS. 3A and B, is inserted into the opening 208 in a half. In one embodiment, the contact has a striker 301 that is bent outward from the exterior of the pill. The striker 301 is a cantilever spring, and has a substantially triangular cross section, as illustrated in FIG. 3A. When the pill is inserted into the battery compartment of the hearing aid, the striker 301 connects with a recessed programming contact in the battery compartment.

The programming contact 300 also includes a tab 303 that is bent at about a ninety degree angle from the body 305 of the programming contact 300. The tab 303 projects into the interior of the pill when the programming contact 300 is inserted into a half.

Figure 4B:
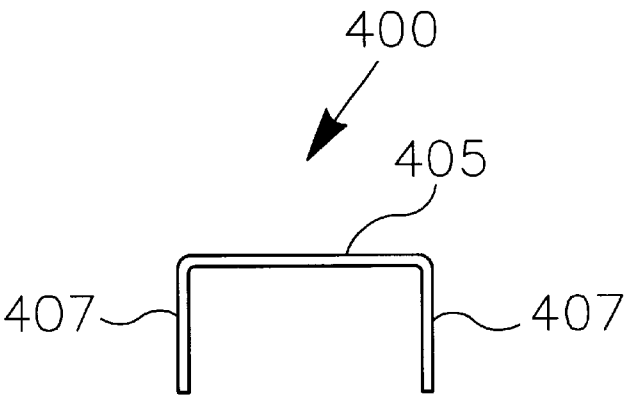
FIG. 4B illustrates a plan view of one embodiment of the power contact.
Figure 4A:
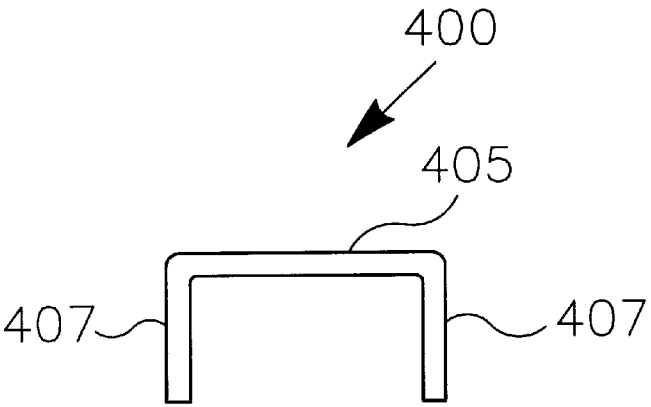
FIG. 4A illustrates a side view of one embodiment of a power contact.

The second contact, illustrated in FIGS. 4A and B, is a power contact 400. The power contact 400 includes a front contact 405 and two side tabs 407. The side tabs 407 are substantially parallel to one another, and substantially perpendicular to the front contact 405. The front contact 405 is positioned in an opening 207 to be substantially flush with the front side 209 of a half so that the power contact 400 is less likely to inadvertently connect with a programming contact recessed within the wall of the battery compartment of the hearing aid. If the power contact 400 inadvertently connects with the hearing aid's programming contact, the hearing aid's programming circuitry might fail.

Figure 5B:
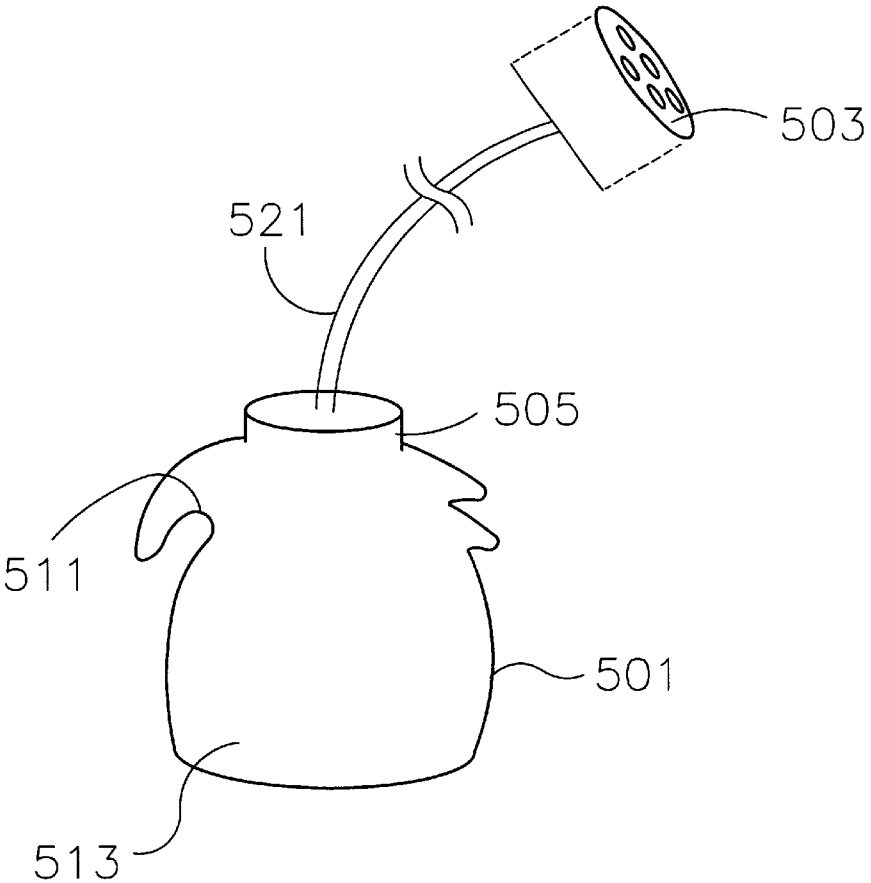
FIG. 5B illustrates one embodiment of a pill coupled to a socket.

In one embodiment, a socket that is associated with the pill is coupled to the programming and power contacts 300, 400 by wires, or a flexible thin film circuit board, that are attached, for example by soldering, to the tabs 303, 405 of the programming and power contacts 300, 400. In a further embodiment, the socket is an industry standard programming socket (e.g., a CS43, CS44, or CS45 socket by Microtronics U.S. Inc. (Northbrook, Ill.)). In yet a further embodiment, the socket 503 is mounted in the neck 505 of the pill 501, as illustrated in FIG. 6. In an alternative embodiment, the socket 503 is not mounted in the pill 501, but is coupled to the pill by the wires 521, which may be in the form of a cable, as illustrated in FIG. 5B.

The programming and power contacts 300, 400 are supported in each half 201, 202 by contact plates 601, 602, illustrated in FIGS. 6A–D. Each contact plate has a front and back side 609, 610. The contact plates 601, 602 are snap fitted into, and securely held by, corresponding halves 201, 202. Specifically, the front side 809 of each contact plate is inserted towards the back side 210 of a corresponding half, and thus supports the programming and power contacts 300, 400. The two halves 201, 202 are then attached together to form the pill 501.

In one embodiment, the halves 201, 202 and the contact plates 601, 602 are formed from an insulator, such as injection molded plastic. The programming and power contacts 300, 400 are formed from conductors, such as metal.

The pill 601 is further formed by attaching the two halves 201, 202 in the following manner. One half 202, and the contact plate 602 inserted within it, each have posts 211, 611. The other half 201, and the contact plate 601 inserted within it, each have receptacles 212, 612. The posts 211, 611 of the half 202 and contact plate 602 are snap fitted into the corresponding receptacles 212, 612 of the other half 201 and contact plate 601. In one embodiment, dabs of glue can be placed upon the posts 211, 611 to further secure the two halves 201, 202 to one another.

Two screws 507 are inserted into a pair of holes 231, 232 in both halves 201, 202 to secure the two halves 201, 202 to one another. Finally, in yet another embodiment, a band 509, for example made from metal, is placed around the neck 505 of the pill 501 to further secure the two halves 201, 202 to one another, and the socket 503 in the pill 501. The front sides 209 of each half form two opposite exterior sides of the pill 501. A programming contact 300 and a power contact 400 are positioned on each exterior side 513.

The pill 501 is inserted into the hearing aid's battery compartment in the following manner. First, the battery door is removed from the hearing aid. The battery door is hinged on an axle about the hearing aid's battery compartment. Thus, the axle is exposed by the battery door's removal.

Figure 5A:
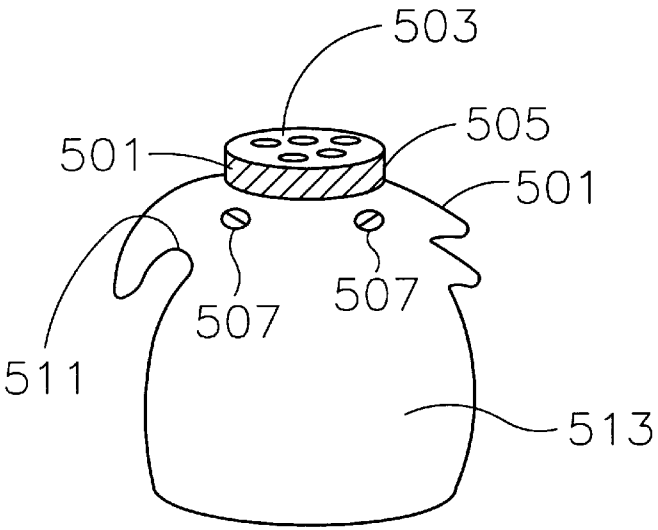
FIG. 5A illustrates one embodiment of the pill including a socket.
Figure 6A:
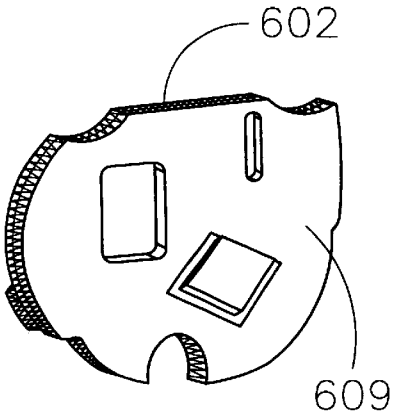
FIGS. 6A–D illustrates one embodiment of a pair of contact plates.
Figure 6B:
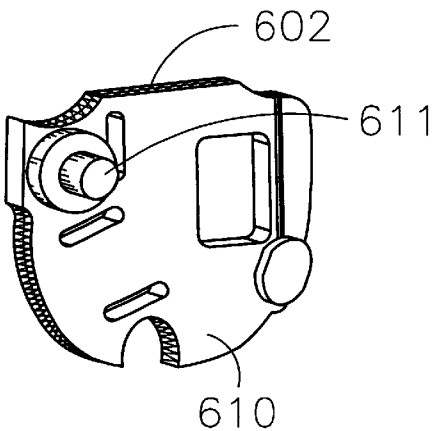
Figure 6C:
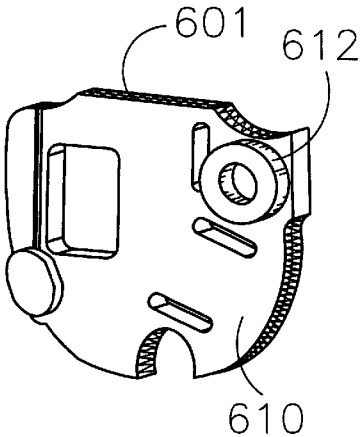
Figure 6D:
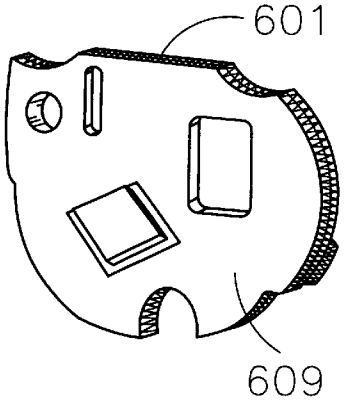

Then, the pill 501 is attached to the hearing aid by snapping the pill's hinge 511, illustrated in FIG. 5, over the axle. Next, the pill 501 is pivotally moved about the axle to be inserted into the battery compartment. The pill 501 is snapped into place in the battery compartment so that the pill's programming and power contacts 300, 400 connect with corresponding hearing aid contacts in the battery compartment. Because of its design, the pill 501 is positively inserted into the battery compartment so that the pill 501 does not move about in the battery compartment once it has been inserted there. Positive insertion ensures that the contacts of the pill 501 and hearing aid are connected consistently, and not intermittently. Also, because of the asymmetrical position of the hinge on the pill 501, the pill 501 is indexed so that it can not be inserted into the hearing aid so that the programming and power contacts of the pill and hearing aid are not inadvertently and inappropriately connected, such as in reverse. As a result, the hearing aid can be programmed and powered by a programming system coupled to the hearing aid by the pill 501.

Conclusion

The present invention provides a programmable hearing aid pill and methods of manufacturing and using the same. It is an advantage of the present invention that the hearing aid's acoustical performance is not substantially affected when the pill, in lieu of the battery, is inserted in the battery compartment.

It is understood that the above description is intended to be illustrative, and not restrictive. For example, the pill can be used in other systems, such as other audio systems. Many embodiments will be apparent to those skilled in the art upon reviewing the above description.

What is claimed is:

1. An apparatus for progamming a hearing aid, the hearing aid including a battery compartment, into which a hearing aid battery may be inserted and battery compartment door may be attached, comprising an indexed pill that substantially replicates the dimensions of the hearing aid battery and the battery compartment door, wherein the indexed pill may be inserted into the battery compartment in lieu of the battery and battery compartment door, wherein the indexed pill comprises two halves, each of which has a front side and a back side, further comprising two power contacts one on each front side and two programming contacts one on each front side.

2. The apparatus of claim 1, wherein each programming contact has a striker bent outwardly from the exterior of the indexed pill.

3. The apparatus of claim 1, further comprising two contact plates, wherein each contact plate is inserted into a corresponding half to support the contacts.

4. The apparatus of claim 1, further comprising a socket, mounted in the indexed pill, coupled to the power and programming contacts.

5. The apparatus of claim 4, wherein the socket is an industry standard programming socket.

6. An apparatus, comprising:

a programming system for a hearing aid having a battery compartment and a battery compartment door;

an indexed pill coupled to the programming system; and wherein the indexed pill substantially replicates the dimensions of a hearing aid battery and battery compartment door, wherein the indexed pill may be inserted into the battery compartment in lieu of the battery and battery compartment door, and wherein the indexed pill comprises two halves, each of which has a front side and a back side, further comprising two power contacts one on each front side and two programming contacts one on each front side.

7. The apparatus of claim 6, further comprising:

a programmable hearing aid into which the indexed pill is positively inserted in lieu of a battery;

wherein the programmable hearing aid includes, a microphone, a speaker, an amplifier coupling the microphone and speaker, programming electronics, coupled to the amplifier, which control the frequency response of the amplifier in response to programming signals from the programming system, and wherein the amplifier and programming electronics are coupled to the indexed pill; and wherein the insertion of the indexed pill into the programmable hearing aid does not substantially affect the acoustical performance of the programmable hearing aid.

8. The apparatus of claim 6, wherein each programming contact has a striker bent outwardly from the exterior of the indexed pill.

9. The apparatus of claim 6, further comprising two contact plates, wherein each contact plate is inserted into a corresponding half to support the contacts.

10. The apparatus of claim 6, further comprising a socket, mounted in the indexed pill coupled to the power and programming contacts.

11. The apparatus of claim 10, wherein the socket is an industry standard programming socket.

12. A method, comprising:

providing an indexed pill that substantially replicates the dimensions of a programmable audio system for a hearing aid, the hearing aid having a battery and battery compartment door and comprises two halves, each of which has a front side and a back side;

inserting the indexed pill, in lieu of the battery and battery compartment door, into a battery compartment of a programmable audio system so as not to substantially affect the acoustical performance of the programmable audio system; and providing programming signals and power to the programmable audio system from the programming system through the front sides of the indexed pill.

13. The method of claim 12, further comprising removing the battery door from the programmable audio system, and wherein inserting comprises attaching a hinge of the indexed pill onto an axle of the programmable audio system, and pivotally inserting the indexed pill into the battery compartment.

* * * * *